US008920602B2

(12) United States Patent
Blackstone et al.

(10) Patent No.: US 8,920,602 B2
(45) **Date of Patent: *Dec. 30, 2014**

(54) COMPOSITIONS AND PROCESSES TO INCREASE PULP YIELD, REDUCE EXTRACTIVES, AND REDUCE SCALING IN A CHEMICAL PULPING PROCESS

(76) Inventors: Michael M. Blackstone, Jacksonville, FL (US); Atif M. Dabdoub, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/897,380

(22) Filed: Oct. 4, 2010

(65) Prior Publication Data

US 2011/0240237 A1 Oct. 6, 2011

Related U.S. Application Data

(63) Continuation of application No. 11/472,498, filed on Jun. 21, 2006, now Pat. No. 7,807,021.

(51) Int. Cl.

| | |
|---|---|
| ***D21C 3/22*** | (2006.01) |
| ***C08F 30/02*** | (2006.01) |
| *D21C 3/02* | (2006.01) |

(52) U.S. Cl.
CPC . *D21C 3/226* (2013.01); *D21C 3/02* (2013.01)
USPC ..... 162/80; 162/46; 162/70; 526/278

(58) Field of Classification Search
CPC ..... D21C 3/226; D21C 3/22
USPC ..... 162/48, 70, 80; 526/278
See application file for complete search history.

(56) References Cited

U.S. PATENT DOCUMENTS

| | | | | |
|---|---|---|---|---|
| 2,999,045 | A | 9/1961 | Mitchell et al. | |
| 3,036,118 | A | 5/1962 | Jackson et al. | |
| 3,898,037 | A * | 8/1975 | Lange et al. | 422/16 |
| 4,080,375 | A * | 3/1978 | Quinlan | 562/14 |
| 4,201,669 | A | 5/1980 | Becker et al. | |
| 4,426,254 | A | 1/1984 | Wood et al. | |
| 4,446,046 | A | 5/1984 | Becker | |
| 4,673,460 | A | 6/1987 | Raff | |
| 4,906,331 | A | 3/1990 | Blackstone et al. | |

(Continued)

FOREIGN PATENT DOCUMENTS

EP 517470 A2 * 12/1992

OTHER PUBLICATIONS

ChemStone Inc, ChemStone Inc website including DSC-400 MSDS [downloaded from www.archive.org], Mar. 17, 2005 [downloaded on Jan. 14, 2010.*

(Continued)

*Primary Examiner* — Anthony Calandra
(74) *Attorney, Agent, or Firm* — Dority & Manning, P.A.

(57) ABSTRACT

In general, the present disclosure is directed to compositions and processes to increase pulp yield, reduce extractives, and reduce scaling in a chemical pulping process. In one particular embodiment, for instance, the present disclosure is directed to a composition comprising a surface active agent, an alkaline mixture, at least one polymer, the polymer having a linear backbone segment having two ends, at least one phosphorus component, the phosphorus component chemically linked along the linear backbone segment of the polymer, and at least one end component, the end component chemically linked to one or both ends of the linear backbone segment of the polymer.

19 Claims, 11 Drawing Sheets

(56) References Cited

U.S. PATENT DOCUMENTS

| | | | | | |
|---|---|---|---|---|---|
| 4,952,277 | A | | 8/1990 | Chen et al. | |
| 5,032,224 | A | | 7/1991 | Ahluwalia | |
| 5,223,089 | A | | 6/1993 | Kato | |
| 5,250,152 | A | | 10/1993 | Ling et al. | |
| 5,259,974 | A | * | 11/1993 | Chen et al. | 210/700 |
| 5,298,120 | A | | 3/1994 | Blackstone | |
| 5,376,731 | A | | 12/1994 | Kerr et al. | |
| 5,490,942 | A | * | 2/1996 | Kuczynski | 210/700 |
| 5,501,769 | A | | 3/1996 | Blackstone et al. | |
| 5,519,102 | A | | 5/1996 | Cady et al. | |
| 5,647,995 | A | * | 7/1997 | Kneller et al. | 210/699 |
| 5,728,265 | A | | 3/1998 | Saint Victor et al. | |
| 6,036,817 | A | | 3/2000 | Victor et al. | |
| 6,444,747 | B1 | | 9/2002 | Chen et al. | |
| 6,489,287 | B1 | * | 12/2002 | Gauthier et al. | 510/476 |
| 6,740,199 | B2 | | 5/2004 | Khan et al. | |
| 6,890,404 | B2 | | 5/2005 | Thompson et al. | |
| 7,420,081 | B2 | | 9/2008 | Dabdoub | |
| 2002/0094299 | A1 | | 7/2002 | Nguyen et al. | |
| 2003/0073805 | A1 | * | 4/2003 | Davis et al. | 528/287 |
| 2004/0074616 | A1 | | 4/2004 | Sears et al. | |
| 2006/0009654 | A1 | | 1/2006 | Dabdoub | |

OTHER PUBLICATIONS

*Industrial Polymers & Chelants Chemistry and Applications; Part 1*: Theory of Scale Formation & Prevention by Atif M. Dabboub, Ph.D., Mar. 1998.

*Chelates in Water Treatment*, 3rd Annual Connection Association of Water Technologies, Inc,, by Atif M. Dabdoub, Ph.D, Orlando, FL—Nov. 29, 1990.

*Phosphonates as Additives in Kraft Pulping—A Preliminary Investigation*, by Wei Li and Ulrike Tschirner; Tappi Journal, pp. 22-27, Nov. 2002.

*Phosphonates as Additives in Kraft Pulp*, by Ulrike Tschirner and Timothy Smith, Assistant Professor, Dept. of Wood and Paper Science, University of Minnesota, St. Paul, MN.

*Phosphonates as Additives in Kraft Pulping*, by Wei Li and Ulrike Tschirner, Dept. of Wood & Paper Science, University of Minnesota, St. Paul, MN, TAPPI 2001 Pulping Conference.

*Evaluating Polymers and Phosponates for Use as Inhibitors for Calcium, Phosphate and Iron in Steam Boilers—Part 1*, by Dovovan Erickson, US Water Services/Uriliry Chemicals, The Analyst, Fall 2003.

*Environmental Chemistry of Phosphonates*, by Bernd Nowack, Water Research, Aug. 16, 2002, pp. 1-14.

*Fate of Metal Cations in the Kraft Pulping Process Modified by Phosphonates*, by Wei Li and Ulrike Tschirner, Department of Wood and Paper Science, University of Minnesota.

*The Efficient Use of Hydrogen Peroxide as a Chemical Pulp Delignification Agent, The Macrox$^{SM}$ Process*, by Nick Troughton and Pierre Sarot, 1992 Pulping Conference; TAPPI Proceedings, pp. 519-535.

*Stabilizers for Deinking and Bleaching: Lastabil™ 923 and 928*, by Inge Bast and Michael Ellis, TAPPI Proceedings 90, pp. 103-114.

*Special Phosphorus Compounds* by Robert R. Cavano, Technically Speaking.

* cited by examiner

FIG. 8

| Sample ID | Kappa Number | Dichloromethane Extractables, % | DSC 400m dose |
|---|---|---|---|
| Weyerhaeuser Decker 4-17-06 | 20.65 | 0.100 | 0.5 lb/ton |
| Weyerhaeuser Decker 4-19-06 | 21.63 | 0.045 | 1.0 lb/ton |
| Weyerhaeuser Decker 4-21-06 | 17.35 | 0.057 | 1.0 lb/ton |

COMPOSITIONS AND PROCESSES TO INCREASE PULP YIELD, REDUCE EXTRACTIVES, AND REDUCE SCALING IN A CHEMICAL PULPING PROCESS

BACKGROUND

The majority of corrugated boxes, paper grocery bags, fine papers, and market pulps are produced by a sulfate pulping process known as "Kraft" pulping. The process is characterized by the fact that sodium sulfide is added to the medium that is used to cook the wood chips and produce pulp. When this technique was introduced over a century ago, the addition of sodium sulfide produced a dramatic improvement in pulp strength, pulp yield, and durability of the paper made therefrom.

In the typical Kraft digestion process, wood chips are added to an aqueous medium consisting mostly of white liquor which will be transformed into black liquor during the cook. In general, the liquor in which the wood chips are cooked, or cooking liquor, comprises a mixture of black and white liquor, the black liquor being liquor added back to the cooking vessel, or digester, from a prior batch of wood chips and the white liquor being a freshly prepared alkaline solution as described below. Black liquor varies considerably among different mills depending on the white liquor used, the wood employed, and the method of cooking. Typical white liquor is a solution of sodium hydroxide, sodium carbonate, sodium sulfate, sodium sulfide and various inorganic materials. White liquor solubilizes the pulp and removes the lignin from the wood fibers as described below.

The largest part of the organic matter removed from the wood during cooking is combined chemically with sodium hydroxide in the form of sodium salts. Some of these compounds are resin soaps which account for the intense foaming properties of black liquor. In addition, organic sulfur compounds and mercaptans, which give the characteristic odor to the sulfate-containing black liquor, and small amounts of sodium sulfate, silica and other impurities such as lime, oxide, alumina, potash, and sodium chloride are present in the black liquor.

In the pulping process, pre-sized wood chips are subjected to the alkaline reagents at elevated temperatures and pressures in a digester vessel. Generally, temperatures range from about 250° F. to about 350° F., and pressures range from about 60 psi/g to about 130 psi/g. Digestion time may range from 30 minutes to 10 hours, depending on the process conditions and the desired pulp/paper characteristics.

Competing reactions are also in play. Calcium in the cooking liquor and in the wood (normally bound to the cellulose, but released upon contact with the alkali) form sticky precipitates with fatty and resin acids, swelling to block flow channels. Excess calcium can form precipitates with lignin, and hemicellulose among others. Such precipitates can present many difficulties in later stages. In high heat transfer areas, calcium cations form tenacious scales, reducing flow and heat transfer. In addition to calcium, certain other metals can catalyze the hydrolysis of wood sugars, hemicellulose, and cellulose, and can interfere in certain oxidation/reduction reactions. Moreover, aluminum, calcium, magnesium, and transition metals (especially manganese, copper, and iron) can interfere with bleaching as well as other processes.

The reaction conditions present during the cook, or digestion, cause lignin, the amorphous polymeric binder found in wood fibers, to be hydrolyzed. Ideally, wood chips are digested only long enough to dissolve sufficient lignin to free the cellulosic wood fibers but maintain sufficient lignin intact to provide added strength to the paper. The pulping process attempts to maximize pulp yield, which is defined as the dry weight of pulp produced per unit dry weight of wood consumed.

After sufficient lignin has been dissolved to free the cellulosic wood fibers, the digester charge is blown into a receiving vessel, or blow tank. The sudden drop in pressure from the digester to the blow tank causes additional mechanical breakup of the wood fibers. In some papermaking applications, the residual lignin is removed to produce papers without the characteristic brown color of Kraft paper. In producing linerboard or Kraft paper, however, the lignin residue remains in the papermaking pulp so that the highest possible strength of wood pulp is achieved.

Ideally, each of the wood chips blown from the digester into the blow tank is broken down into separate wood fibers. In practice, however, some of the wood chips fail to completely separate due, in part, to the undissolved lignin remaining in the pulp. These unseparated particles are removed from the wood pulp by passing the pulp through a screen having openings of a predetermined size. In the pulping industry, the standard test screen employed is flat with 0.001 inch slots therethrough.

The materials that are recovered by this screening process are known as "rejects". The rejects include wood fibers that could be used to produce paper. Accordingly, it is highly desirable to decrease the amount of rejects. One method of lowering the amount of rejects is by increasing the digestion time or by creating more severe hydrolysis conditions. Such conditions, however, increase the costs involved and cause some of the cellulose in the wood chips to be hydrolyzed and rendered unusable.

After contact with liquor in the digester, inorganics, any unused surfactants that may have been added and solubilized lignin and resins are removed from the pulp in one or more washing steps. Temperatures in the digestion and washing stages typically vary from about 250° F. to 340° F. and 100° F. to 200° F., respectively. After washing, the pulp may be subjected to further bleaching or purification treatments as desired before being sheeted and dried, or prepared for sale, or further utilized in making paper.

A Kappa number corresponds directly to the amount of lignin remaining in the pulp. Generally, the higher the Kappa number, the more lignin present in the pulp and, therefore, the higher the pulp yield. The Kappa number generally decreases as the digestion time is increased or the alkalinity of the cooking liquor is increased. The goal in such Kraft papermaking processes is to retain as much lignin as possible in order to enhance strength and to reduce the cost, while maintaining the uniformity of the cook. More uniform cooks result in a decreased percentage of rejects and, thereby, reduce costs for running paper mills.

Cooking, or digestion, of the pulp may be terminated when the amount of rejects in the pulp is reduced to an acceptable level. Substantial yield and quality advantages are achieved if the wood chips are cooked to a higher lignin content. As a result, an increase in a Kappa number target by the use of thinner chips can result in a substantial cost savings. However, the thickness of chips obtainable on a commercial scale is always variable. A major portion of the total rejects frequently originate from a relatively small fraction of the chips having the greatest thickness. The objective in every pulping process is to achieve a lower percentage of rejects.

In recent years, various surfactants have been added to the pulp cooking medium to increase deresination of the wood pulp. Deresination removes various resins found in wood, including lignin, tannins, and organic solvent-extractable materials, such as fats, fatty acids, resin acids, sterols and hydrocarbons. U.S. Pat. No. 4,426,254 to Wood et al. describes a $C_{12}$-alpha olefin sulfonate or $C_{21}$-dicarboxylic acid as a solubilizing agent in combination with a deresination agent consisting of sodium hydroxide and an ethylene oxide condensation product. The composition removes resins so that fouling of process equipment and foaming in process streams are reduced. Moreover, deresination provides for production of high grade cellulose which may be used in various manufactured cellulose-containing products. Another deresination agent is described in U.S. Pat. No. 2,999,045 to Mitchell et al. as a block copolymer of polyethylene oxide and polypropylene oxide. Such block copolymers as described therein are "reverse" Pluronics, and are manufactured and sold under the names PLURONIC LR-44, PLURONIC R-62, PLURONIC LR-64 and PLURONIC F-68.

A process for enhancing the cooking of wood chips for producing pulp is described in U.S. Pat. No. 4,906,331 to Blackstone et al. As described therein, a block copolymer of polyethylene oxide and polypropylene oxide having a molecular weight of from 500 to 30,000 is added to the pulp cooking liquor to form a Kraft pulp. The polyethylene oxide portion of the block polymer described therein is present in the reagent in an amount of from about 20% to about 80%. Such surfactants are sold by BASF Wyandotte Corporation (hereinafter "BASF") under various tradenames including PLURONIC L-62, PLURONIC L-92 and PLURONIC F-108.

The particular block copolymer surfactants described in the '331 patent have been found to be only partially soluble in both highly alkaline solutions such as white liquor and in low alkaline solutions such as weak black liquor having alkali concentrations as low as 5 grams per liter. Lab work has also shown that a waxy precipitate often forms on the surface of hot white liquor when the surfactant described by the '331 patent is employed.

U.S. Pat. No. 4,952,277 to Chen et al, describes a process for making paper and linerboard employing a phenoxy ethyleneoxy alcohol surface active agent. The particular agent described therein is sold under various names such as IGEPAL® RC-520, TRITON® X-100, and SURFONIC® N-95 sold by GAF Corp., Rohm and Haas Co. and Texaco Chemical Co., respectively. The patent discloses that the surface active agent may be used in combination with the ethylene/propylene block copolymer described in the '331 patent.

Anthraquinone is another reducing agent that has been used as an alternate to sodium sulfide in the Kraft pulping process. The expense of anthraquinone limits its use by most paper mills. Also, scaling and/or fouling of evaporators downstream as well as fouling of tall oil distillation towers has been reported. Some of the previously mentioned surfactants, including the block copolymers, have, however, produced a synergistic effect when employed in combination with anthraquinone.

Blackstone, in U.S. Pat. No. 5,298,120, describes the use of a fatty acid ester of the block copolymers such as PLURONIC L-62 and F-127 as a means of providing a stable surfactants in a hot, alkaline medium, thereby providing reduced rejects, lower kappa numbers, higher intrinsic viscosity and higher yield. This has provided a commercial success, with over 5 million tons of pulp treated in North America.

Blackstone continues, in U.S. Pat. No. 5,501,769, describing the use of a fatty acid ester of polyoxyalkene polymers chosen from a polyoxyethylene and polyoxypropylene polymers. These materials are stable in hot, alkaline medium, and provide reduced rejects, lower kappa numbers, higher intrinsic viscosity, and higher yield.

Other references describe the use of a silicone based wetting agent. Some references describe the use of castor oil ethoxylates in conjunction with anthraquinone to increase yield and reduce alkaline liquor requirements.

Although various agents and processes have been employed to enhance the cooking of wood pulp as well as to cause deresination, reduced rejects, and increased yield, the particular features of the present invention have not heretofore been known. Whereas all of the earlier patents describe a mechanism of chip penetration, and solution of resin acid precipitates, and the later Blackstone patents describe reduction in repreciptitation of the dissolved lignin byproducts, the present invention overcomes the shortcomings of the prior art in that the composition and process disclosed herein result in lower processing costs, easier operational procedures, and increased yield of pulp recovered from various wood sources. Specifically, it provides an increased yield by addressing an entirely different mechanism than the surfactant chemistries discussed above. In using this chemistry, calcium is bound, and is prevented from causing repreciptitation of lignin and extractives in chip flow channels, or onto the fiber. As digestion proceeds, this calcium is prevented from adhering to process equipment as scales. Also, other metals are controlled, preventing them from interfering with oxidation/reduction reactions of the sulfide ions and from catalyzing the hydrolysis of sugars, hemicelluloses, and cellulose. Metals are all found in the ash of wood chips in sufficient quantity to cause the abovementioned interferences. Laboratory testing and actual production evaluations confirm that this new mechanism is additive to the actions of the surfactant chemistries of the prior art. The conventional treatments for calcium control heretofore have been:

Homopolymers of acrylic acid;

Homopolymers of maleic acid;

Copolymers of acrylic and maleic acid;

Terpolymers of maleic anhydride, ethyl acrylate, and vinyl acetate.

It has been found that by using a new and unique blend of polymeric dispersants (these include homopolymers, copolymers, and terpolymers with various functionalities including but not limited to the functionalities mentioned above, but most significantly contains one or more polymers with phosphonate or phosphinate components along the backbone of the carbon chain), that scale and corrosion encountered in the digesting equipment, pulp washers, and evaporators can be controlled while increasing the quality and yield of pulp. The presence of nitrogen and/or sulfur functionalities has been found to be helpful as well.

SUMMARY

In general, the present disclosure is directed to compositions and processes to increase pulp yield, reduce extractives, and reduce scaling in a chemical pulping process. In one particular embodiment, for instance, the present disclosure is directed to a composition comprising a surface active agent, an alkaline mixture, at least one polymer, the polymer having a linear backbone segment having two ends, at least one phosphorus component, the phosphorus component chemically linked along the linear backbone segment of the polymer, and at least one end component, the end component chemically linked to one or both ends of the linear backbone segment of the polymer.

In some embodiments, the phosphorus component may include a phosphonate and a phosphinate. In certain embodiments, the alkaline mixture may include sodium hydroxide, sodium sulfide, and sodium carbonate. In some embodiments, the polymer may include acrylic acid, maleic acid, methacrylic acid, hydroxypropyl acrylate, ethyl acrylate, and vinyl acetate. In certain embodiments, the polymer may be co-polymerized with an alkene. In some embodiments, the phosphorus component may include a phosphonate that may include phosphonic acid, isopropenyl phosphonic acid, or isopropenyl phosphonic acid anhydride. In certain embodiments, the phosphonate is copolymerized with a monomer that may include acrylic acid, maleic acid, methacrylic acid, hydroxypropyl acrylate, ethyl acrylate, and vinyl acetate. In some embodiments, the end component may include nitrogen and sulfur. In certain embodiments, the end component may include a nitrogen compound and a sulfur compound. In some embodiments, the end component may include 2-acrylamido-2-methylpropane sulfonic acid.

In still another embodiment, present disclosure is directed to a composition comprising a surface active agent, an alkaline mixture, at least one polymer, the polymer having a linear backbone segment having two ends, at least one phosphorus component, the phosphorus component chemically linked along the linear backbone segment of the polymer, the phosphorus component comprising a phosphonate and a phosphinate, and at least one end component, the end component chemically linked to one or both ends of the linear backbone segment of the polymer.

DESCRIPTION OF THE DRAWINGS

A full and enabling disclosure, including the best mode thereof to one of ordinary skill in the art, is set forth more particularly in the remainder of the specification, including reference to the accompanying figures in which:

FIG. 8 depicts the impact of increasing DSC400M (a composition in accordance with the present disclosure to increase pulp yield, reduce extractives, and reduce scaling in a chemical pulping process) dosage on pulp extractives;

DETAILED DESCRIPTION

Figure 1:
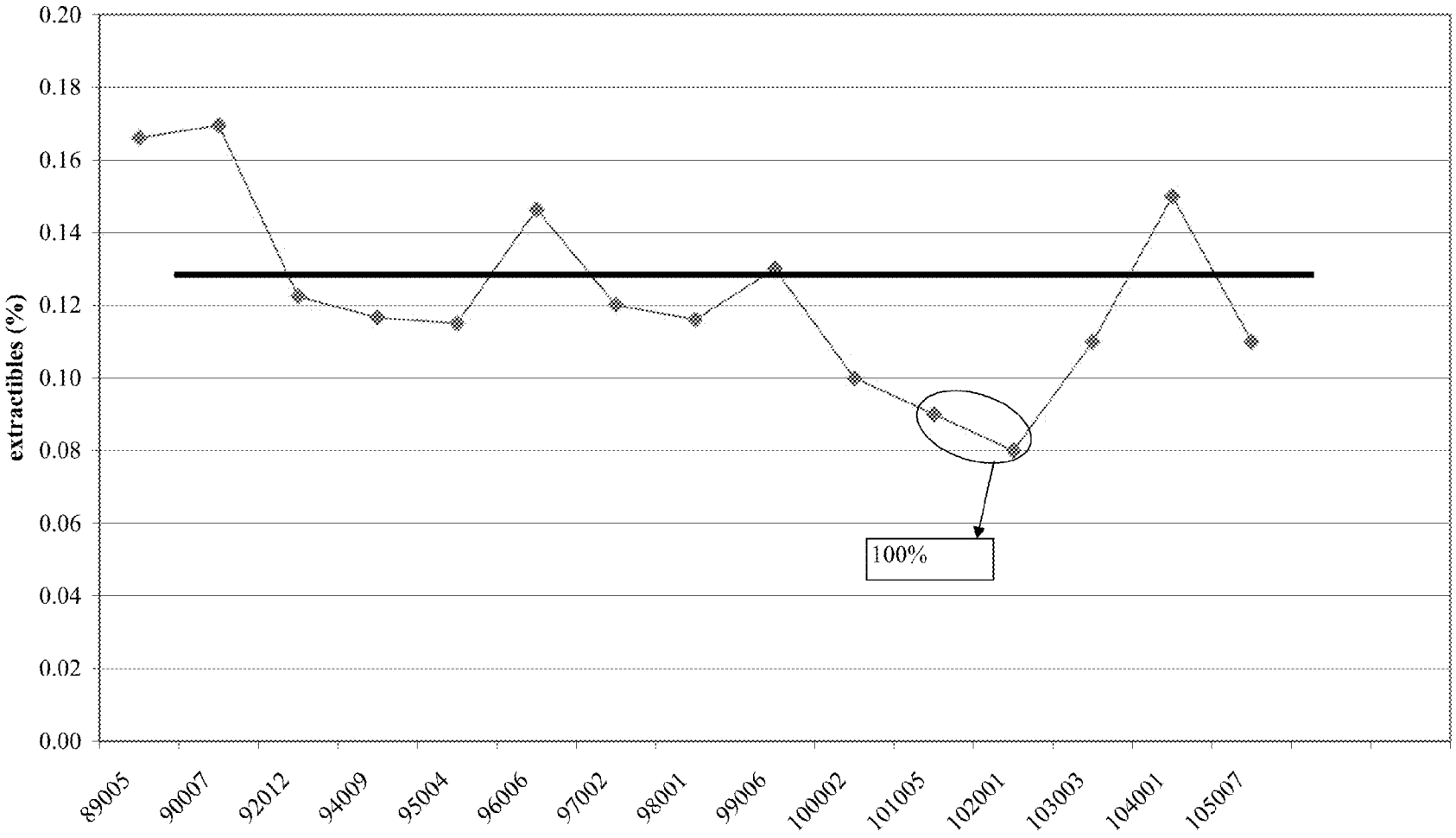
FIG. 1 depicts the impact on extractives of increasing DSC400M (a composition in accordance with the present disclosure to increase pulp yield, reduce extractives, and reduce scaling in a chemical pulping process) dosage from 0.33 lbs/ton to 1.0 lbs/ton.

References are made in detail to present embodiments of compositions and processes to increase pulp yield and reduce scaling in a chemical pulping process, examples of which are described in detail. Each example is provided by way of explanation, and not as a limitation. In fact, it will be apparent to those skilled in the art that modifications and variations can be made without departing from the scope or spirit of the disclosure and claims. For instance, features illustrated or described as part of one embodiment may be used on another embodiment to yield a still further embodiment. Thus, it is intended that the compositions and processes to increase pulp yield and reduce scaling in a chemical pulping process as disclosed herein include modifications and variations as come within the scope of the appended claims and their equivalents.

Very generally, the present disclosure is directed to compositions and processes to increase pulp yield and reduce scaling in a chemical pulping process. A composition containing one or more polymers with phosphonate or phosphinate components along the backbone of the carbon chain is utilized. In other embodiments, a polymer with nitrogen or sulfur functionalities, in addition to phosphorus functionalities is also useful.

The present disclosure overcomes the shortcomings of the prior art in that the compositions and processes disclosed herein result in lower processing costs, easier operational procedures, and increased yield of pulp recovered from various wood sources. Specifically, the compositions and processes of the present disclosure provide an increased yield by addressing an entirely different mechanism than the prior art surfactant chemistries. In using this chemistry, a combination of surfactants and specialized and unique anti-scalant polymers, especially polymers with phosphonate and phosphinate components along the backbone of the carbon chain, calcium is bound, and is prevented from causing repreciptitation of lignin and extractives in chip flow channels, or onto the pulp fiber. As digestion proceeds, calcium is prevented from adhering to process equipment as scale. Scalants such as calcium carbonate, calcium sulfate, calcium phosphate, calcium oxalate, barium sulfate, and the like, are controlled. Also, other metals are controlled, preventing them from interfering with oxidation/reduction reactions of the sulfide ions and from catalyzing the hydrolysis of sugars, hemicelluloses, and cellulose. Such metals can be found in the ash of wood chips in sufficient quantity to cause the abovementioned problems.

By way of example only, the processes of the present disclosure are described as employing compositions made up of a blend of high temperature and high pressure polymeric dispersants containing one or more polymers with phosphonate or phosphinate components along the backbone of the carbon chain. Moreover, by further example, the compositions are described as being used in a Kraft pulping process. The disclosure, however, is not to be so limited. Any of the various equivalent wood cooking processes having the production of paper as its ultimate goal may also be employed. However, the Kraft process is described in more detail as follows.

Initially, suitable trees are harvested, debarked and then chipped into suitable size flakes or chips. The wood chips that can be processed into pulp using the composition and chemical pulping process of the present disclosure can be either hardwoods, softwoods or mixtures thereof. Such wood chips are sorted with the small and the large chips being removed. The remaining suitable wood chips are then moved to a digester. The digester is a vessel for holding the chips and a digesting composition.

Illustratively, in a batch type digester, wood chips and a mixture of "black liquor", the spent liquor from a previous digester cook, and "white liquor", typically a solution of sodium hydroxide, sodium carbonate, sodium sulfate, sodium sulfide and various inorganic materials are pumped into the digester. In the cooking process, lignin, which binds the wood fiber together, is dissolved in the white liquor forming pulp and black liquor. In some embodiments, a blend of high temperature and high pressure polymeric dispersants containing one or more polymers with phosphonate or phosphinate components along the backbone of the carbon chain are added to the white liquor. Other suitable additives can be added to the white liquor as well.

The digester is sealed and the digester composition is heated to a suitable cook temperature under high pressure. After an allotted cooking time at a particular temperature and pressure in the digester, the digester contents (pulp and black liquor) are transferred to a holding tank. The pulp in the holding tank is transferred to the brown stock washers while the liquid (black liquor formed in the digester) is sent to the black liquor recovery area. The black liquor is evaporated to a high solids content in evaporators. The Kraft cook is highly alkaline, usually having a pH of 10 to 14, more particularly 12 to 14.

A Kappa number corresponds directly to the amount of lignin remaining in the pulp. Generally, the higher the Kappa number, the more lignin present in the pulp and, therefore, the higher the pulp yield. The Kappa number generally decreases as the digestion time is increased or the alkalinity of the cooking liquor is increased. The goal in such Kraft papermaking processes is to retain as much lignin as possible in order to enhance strength and to reduce the cost, while maintaining the uniformity of the cook. More uniform cooks result in a decreased percentage of rejects and, thereby, reduce costs for running paper mills.

Cooking, or digestion, of the pulp may be terminated when the amount of rejects in the pulp is reduced to an acceptable level. Substantial yield and quality advantages are achieved if the wood chips are cooked to a higher lignin content. As a result, an increase in a Kappa number target by the use of thinner chips can result in a substantial cost savings. However, the thickness of chips obtainable on a commercial scale is always variable. A major portion of the total rejects frequently originate from a relatively small fraction of the chips having the greatest thickness. The objective in every pulping process is to achieve a lower percentage of rejects.

After one or more washing steps, the pulp may be subjected to bleaching or purification treatments as desired before being sheeted and dried, or prepared for sale, or further utilized in making paper. Such bleaching processes are known in the art.

One embodiment of the present disclosure relates to a composition for increasing pulp yield and reducing the digester cycle time while reducing the pulping or bleaching chemicals required in alkaline chemical pulping processes wherein the composition is added to the digester of the chemical pulping process, the composition comprising one or more polymers with phosphonate or phosphinate components along the backbone of the carbon chain.

In one embodiment of the present disclosure, one or more polymers can be utilized in the compositions and processes of the present disclosure. The polymers are made up of structural units that can include acrylic acid, maleic acid, methacrylic acid, hydroxypropyl acrylate, ethyl acrylate, vinyl acetate, and the like.

In some embodiments, a component is chemically linked to one or more components mentioned above to form linear backbone segments of the polymer with nitrogen, sulfur, and phosphorus functionalities both in the middle and end of the linear backbone segment of the polymer. In some embodiments, the end component can include nitrogen and/or sulfur. In certain embodiments, the end component can include nitrogen and/or sulfur and can include 2-acrylamido-2-methylpropane sulfonic acid.

In some embodiments, one or more phosphonate components are chemically linked to the linear backbone segment of a polymer. Any phosphonate component as would be known in the art can be utilized. In one such embodiment of the present disclosure, a polymer with phosphonate functionality can utilize monomers such as the phosphonic compounds listed below

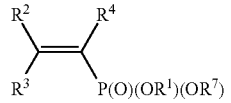

wherein $R^1$-$R^4$ and $R^7$ can be, independently, hydrogen, an alkyl group, a cycloalkyl group, a heterocycloalkyl group, an aryl group, a heteroaryl group, a protecting group, or a combination thereof. In one embodiment, $R^4$ is not an alkyl group. The compounds represented in the formula are referred to herein as unsaturated monomeric phosphonic compounds. These are the precursors for polymers with phosphonates in the backbone of the carbon chain.

In one embodiment, $R^2$ and $R^3$ can be hydrogen. $R^4$ can also be an aryl group or a heteroaryl group. $R^1$ and $R^7$ can be hydrogen. In another embodiment, the compound has the formula $H_2C{=}C(R^9)(PO_3H_2)$, where $R^9$ can be hydrogen, substituted or unsubstituted phenyl, or substituted or unsubstituted benzyl.

In one embodiment, the phosphonic compounds (monomer) utilized in the compositions and processes of the present disclosure have the following formula

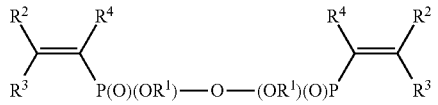

wherein $R^1$-$R^4$ and $R^7$ can be, independently, hydrogen, an alkyl group, a cycloalkyl group, a heterocycloalkyl group, an aryl group, a heteroaryl group, a protecting group, or a combination thereof. $R^2$ and $R^3$ can be hydrogen and $R^4$ can be an aryl group or a heteroaryl group. $R^1$ and $R^7$ can be hydrogen.

In some embodiments, the phosphonic component can include phosphonic acid, isopropenyl phosphonic acid, isopropenyl phosphonic acid anhydride, or the like.

In some embodiments, one or more phosphinate components are chemically linked to the linear backbone segment of a polymer. In one such embodiment of the present disclosure, a polymer with phosphinate functionality can utilize monomers such as the compounds listed below

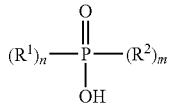

wherein $R^1$ and $R^2$ can include acrylic acid, maleic acid, methacrylic acid, hydroxypropyl acrylate, ethyl acrylate, vinyl acetate, and the like.

In another embodiment of the present disclosure, a polymer with phosphinate functionality can utilize monomers such as the compounds listed below

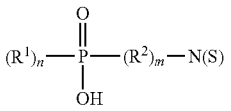

wherein $R^1$ and $R^2$ can include acrylic acid, maleic acid, methacrylic acid, hydroxypropyl acrylate, ethyl acrylate, vinyl acetate, and the like.

In some embodiments, temperature-resistant phosphonates and/or phosphinates are utilized. Such phosphonates and phosphinates can be stable at temperatures above 250° C. In some embodiments, such phosphonates and phosphinates can be stable at temperatures above 350° C.

In some embodiments, pressure-resistant phosphonates and/or phosphinates are utilized. In some embodiments, such phosphonates and phosphinates can be stable at pressures above 50 psi/g. In some embodiments, such phosphonates and phosphinates can be stable at pressures above 100 psi/g. In some embodiments, such phosphonates and phosphinates can be stable at pressures above 125 psi/g.

An effective amount of the compositions of the present disclosure are employed in the digester of a chemical pulping process to increase the amount of pulp produced and/or improve the efficiencies of the chemical pulping processes. The effective amount depends on the particular phosphonate(s) employed and other factors including, but not limited to, wood type, the digester composition, the operating conditions of the digester, the mode of addition of the compounds including any additional compounds added, as well as other factors and conditions known to those of ordinary skill in the art.

In some embodiments, other additives can be added to the alkaline aqueous mixture in the digester. Typical additives include, but are not limited to, conventional additives known for use in the digester of a chemical pulping process.

For example, in some embodiments, various surfactants have been added to the cooking medium to increase deresination of the wood pulp. Deresination removes various resins found in wood, including lignin, tannins, and organic solvent-extractable materials, such as fats, fatty acids, resin acids, sterols and hydrocarbons. Moreover, deresination provides for production of high grade cellulose which may be used in various manufactured cellulose-containing products.

In some embodiments of the present disclosure, the compositions and the processes of the present disclosure enable an increased quantity of pulp yielded from wood chips. The compositions and the processes of the present disclosure can reduce the formation of scaling in the digesting equipment, pulp washers, and evaporators. The compositions and the processes of the present disclosure can prevent the reaction of metals with fatty and resin acids, thereby making such metals easier to remove in washing, thereby improving the bleach chemical efficiency. The compositions and the processes of the present disclosure can reduce the amount of cooking liquor required to produce pulp and can enable reduction in the amount of energy required to produce pulp from wood chips.

In some embodiments of the present disclosure, the compositions and the processes of the present disclosure reduce the amount of organic solids contained in the black liquor of chemical pulping processes. The compositions and the processes of the present disclosure can decrease the number of rejects produced during production of pulp.

EXAMPLES

Figure 2:
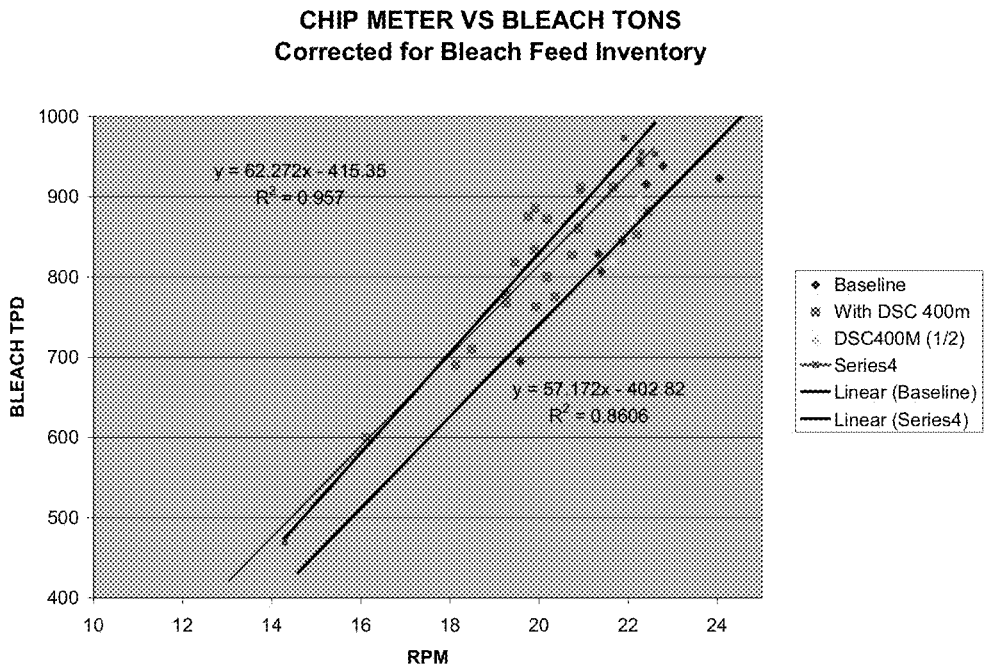
FIG. 2 depicts the impact of increasing DSC400M (a composition in accordance with the present disclosure to increase pulp yield, reduce extractives, and reduce scaling in a chemical pulping process) dosage on production per chip meter RPM.
Figure 3:
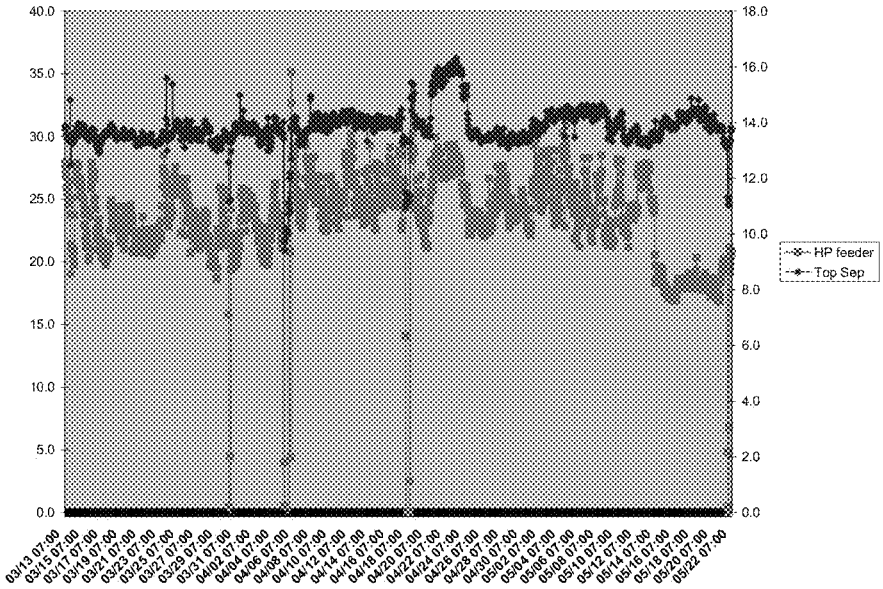
FIG. 3 depicts cleanup by comparing extraction screen Dp's with valve position vs. flow.
Figure 4:
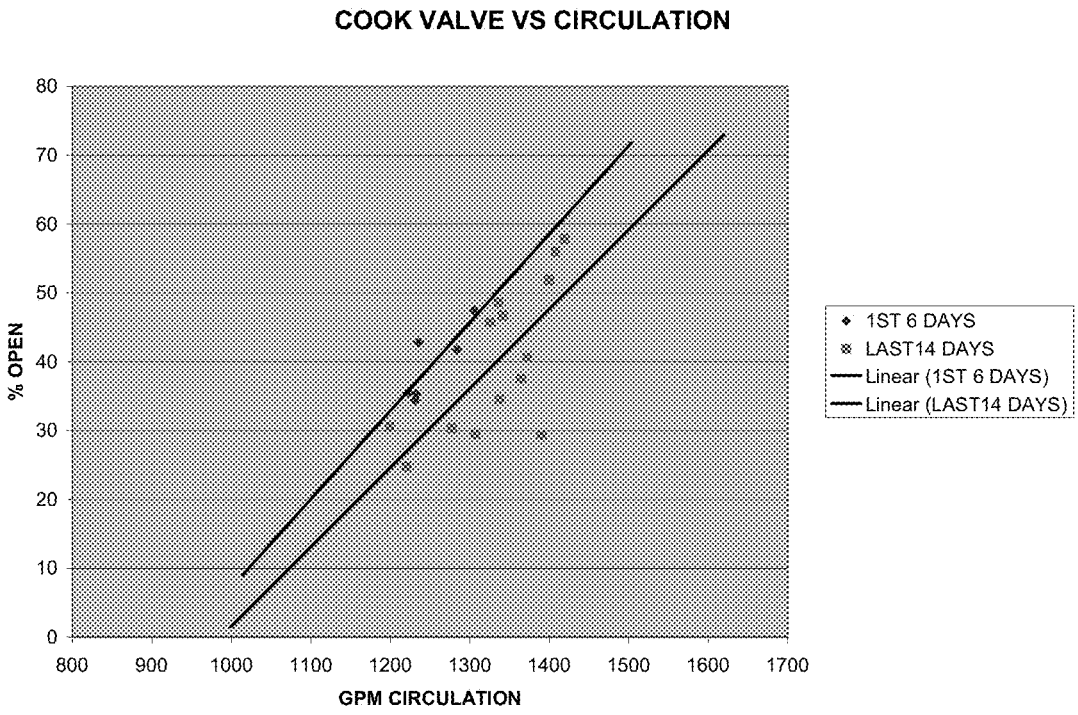
FIG. 4 depicts cleanup by comparing cook control valve vs. circulation.
Figure 5:
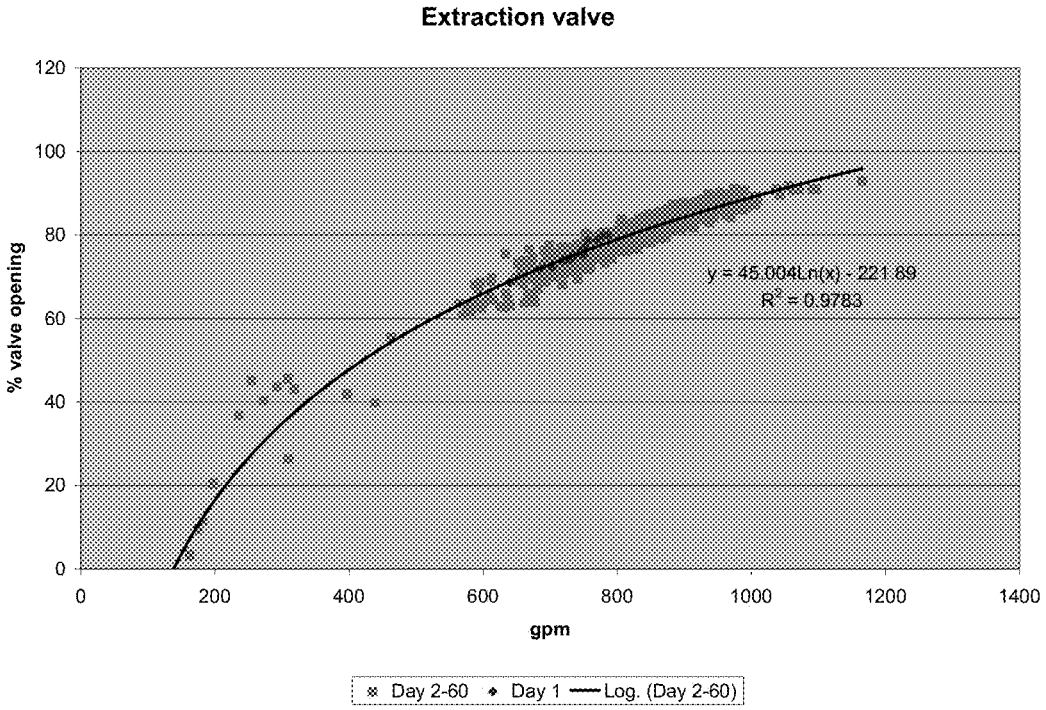
FIG. 5 depicts cleanup by comparing extraction control valve vs. circulation.
Figure 6:
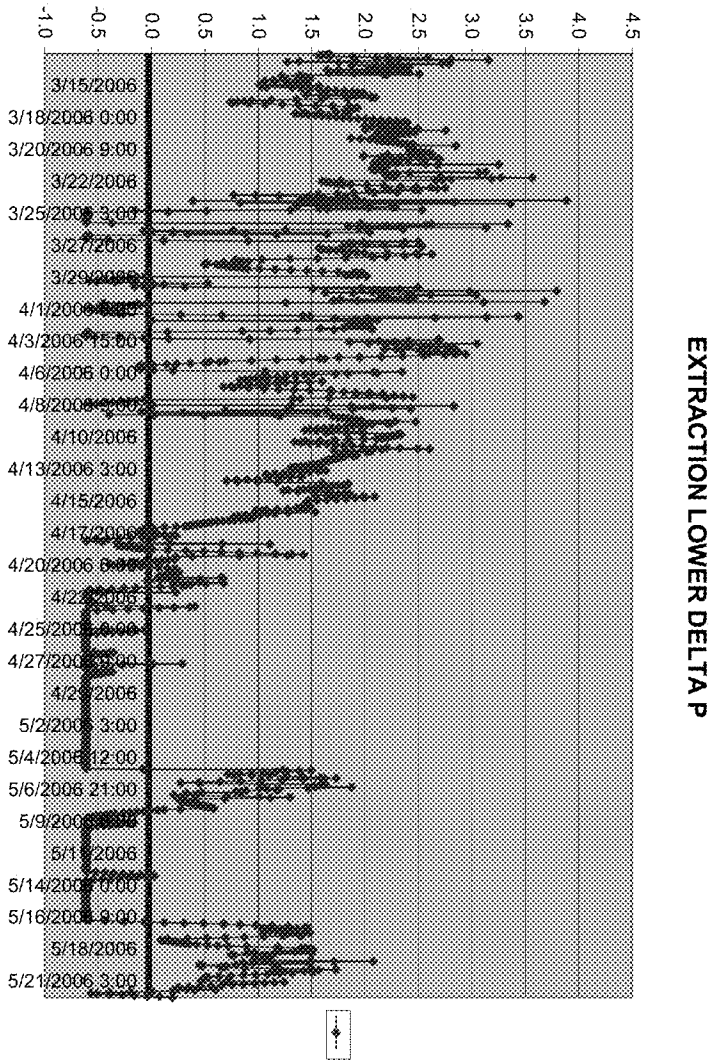
FIG. 6 depicts cleanup by differential pressure across extraction screens.
Figure 7:
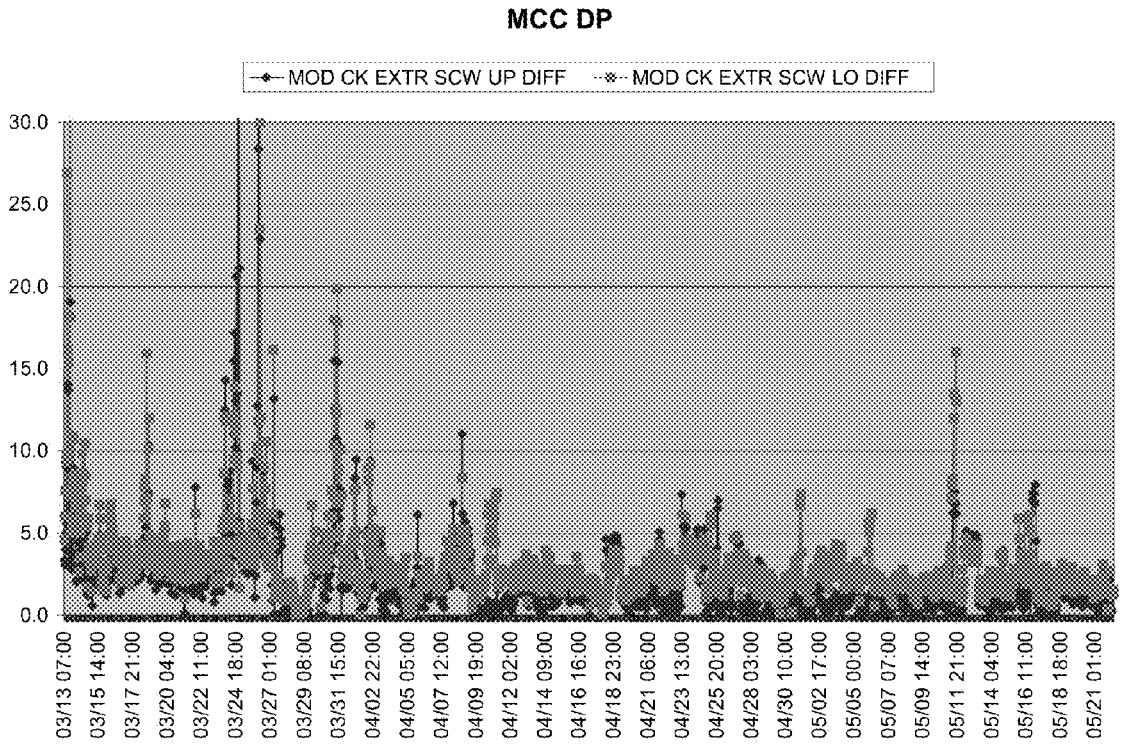
FIG. 7 depicts cleanup by differential pressure across MCC screens.

FIGS. 1-7 depict cleanup of a fouled digester:

FIG. 1 depicts the impact on extractives of increasing DSC400M (a composition in accordance with the present disclosure to increase pulp yield, reduce extractives, and reduce scaling in a chemical pulping process) dosage from 0.33 lbs/ton to 1.0 lbs/ton;

FIG. 2 depicts the impact of increasing DSC400M (a composition in accordance with the present disclosure to increase pulp yield, reduce extractives, and reduce scaling in a chemical pulping process) dosage on production per chip meter RPM;

FIG. 3 depicts cleanup by comparing extraction screen Dp's with valve position vs. flow;

FIG. 4 depicts cleanup by comparing cook control valve vs. circulation;

FIG. 5 depicts cleanup by comparing extraction control valve vs. circulation;

FIG. 6 depicts cleanup by differential pressure across extraction screens;

FIG. 7 depicts cleanup by differential pressure across MCC screens;

FIGS. 8-11 depict a second digester cleaned up from fouled condition. In particular, impact of variable feedrate of DSC400M (a composition in accordance with the present disclosure to increase pulp yield, reduce extractives, and reduce scaling in a chemical pulping process) on yield is depicted. In this regard, yield is indicated by bleached pulp production per chip meter RPM.

Figure 9:
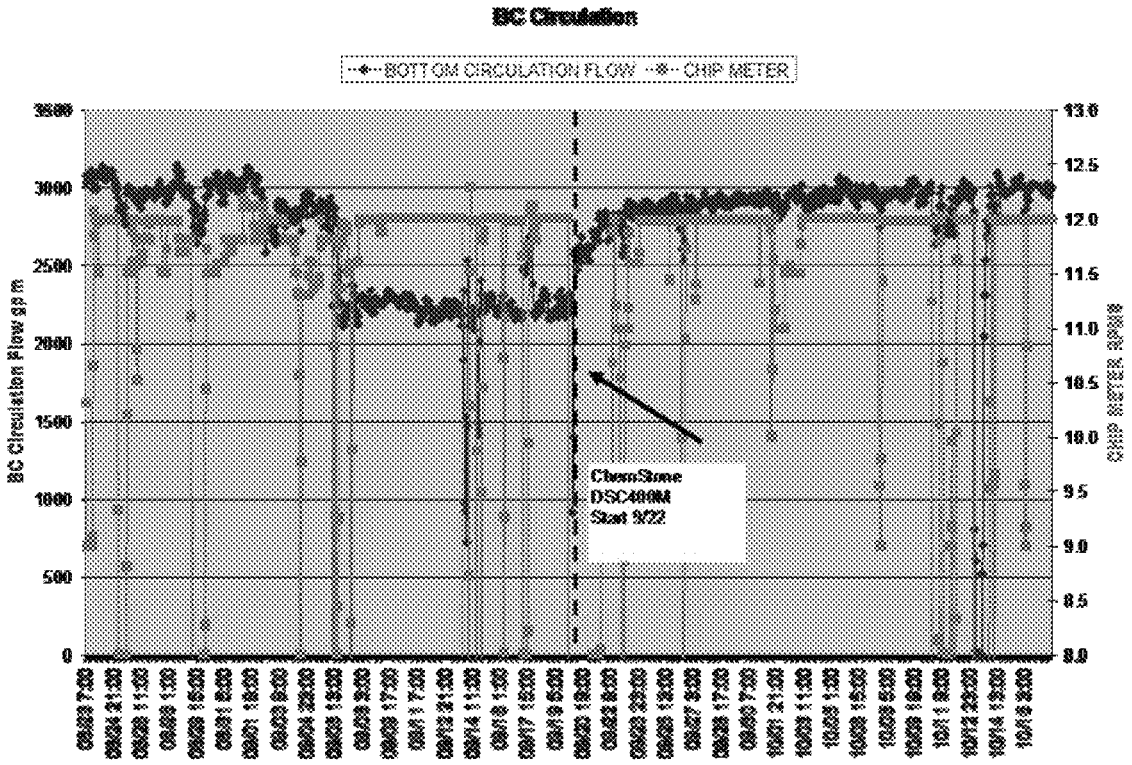
FIG. 9 depicts cleanup of inline drainers and to separators on bottom circulation flow.
Figure 10:
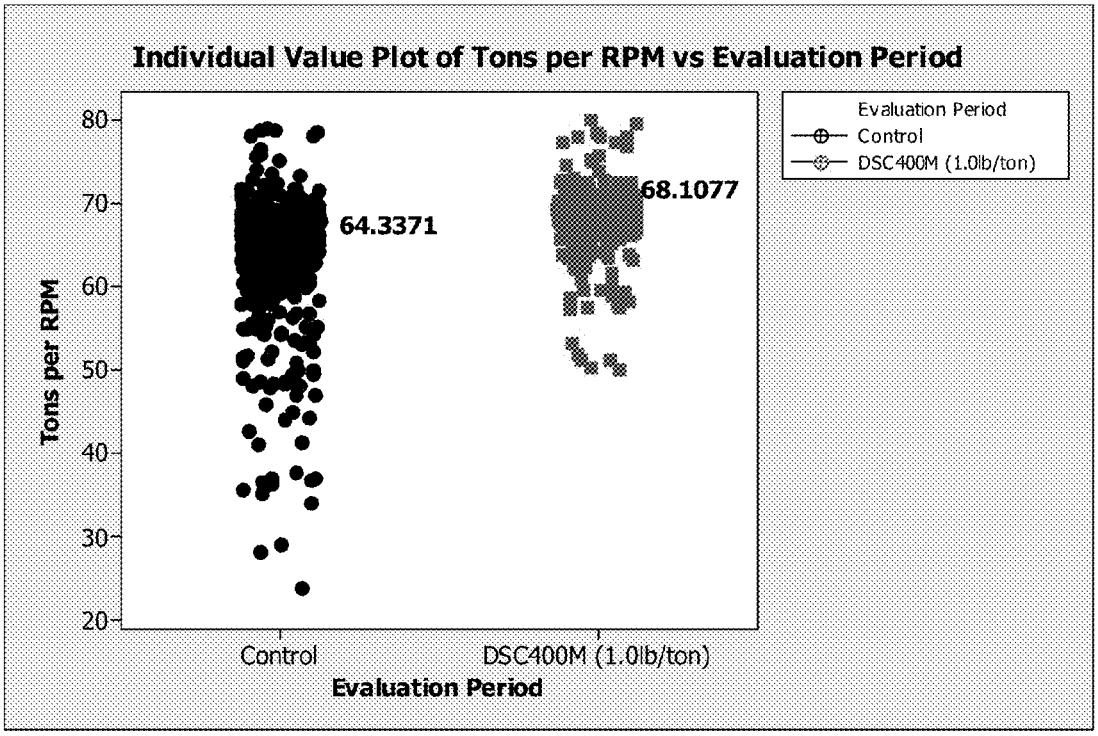
FIG. 10 depicts individual value plot of tons per RPM for the first evaluation period vs. a control period.
Figure 11:
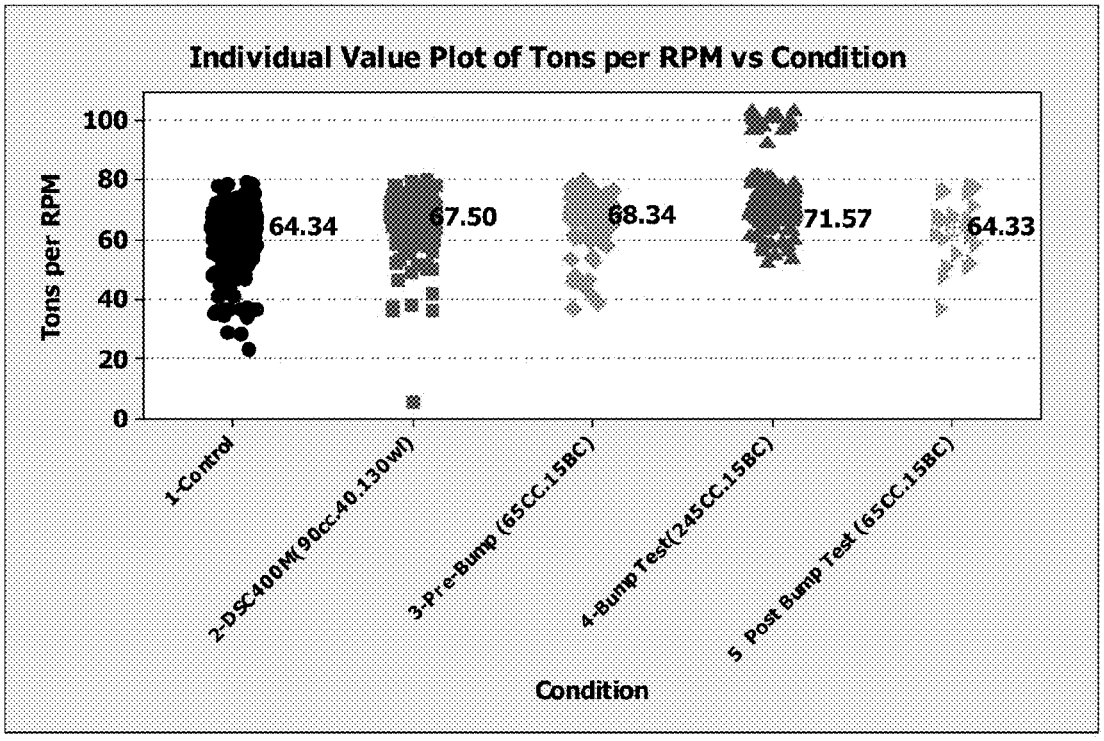
FIG. 11 depicts the effect of lower feedrates of DSC400M (a composition in accordance with the present disclosure to increase pulp yield, reduce extractives, and reduce scaling in a chemical pulping process) on yield as well as a second "bump" test at 1 lb. per ton of DSC400M.

FIG. 8 depicts the impact of increasing DSC400M (a composition in accordance with the present disclosure to increase pulp yield, reduce extractives, and reduce scaling in a chemical pulping process) dosage on pulp extractives;

FIG. 9 depicts cleanup of inline drainers and to separators on bottom circulation flow;

FIG. 10 depicts individual value plot of tons per RPM for the first evaluation period vs. a control period; and FIG. 11 depicts the effect of lower feedrates of DSC400M (a composition in accordance with the present disclosure to increase pulp yield, reduce extractives, and reduce scaling in a chemical pulping process) on yield as well as a second "bump" test at 1 lb. per ton of DSC400M.

It should be understood that the present invention is not limited to the specific compositions or processes described herein and that any composition having a formula or process steps equivalent to those described falls within the scope of the present invention. Preparation routes of the composition and process steps for enhancing the cook of wood chips to produce pulp are merely exemplary so as to enable one of ordinary skill in the art to make the composition and use it according to the described process and its equivalents. It will also be understood that although the form of the invention shown and described herein constitutes a preferred embodiment of the invention, it is not intended to illustrate all possible forms of the invention. The words used are words of description rather than of limitation. Various changes and variations may be made to the present invention without departing from the spirit and scope of the following claims.

What is claimed is:

1. A process for cooking wood in a cooking liquor medium comprising:

contacting wood with a composition comprising an alkaline mixture, a surface active agent, and at least one polymer stable at temperatures above 250° C., the at least one polymer comprising a carbon linear backbone segment having two end components or a carbon and phosphorous linear backbone segment having two end components, the at least one polymer comprising at least one phosphorus containing monomer, the phosphorus containing monomer comprising a phosphorous atom that is either directly chemically linked to the linear backbone segment of the polymer, forms part of the linear backbone segment of the polymer, or any combination thereof, the phosphorus containing monomer comprising a phosphonate, a phosphinate, or any combination thereof wherein the phosphinate is formed from a compound having the structure:

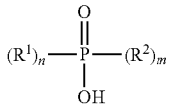

wherein $R^1$ and $R^2$ are, independently, acrylic acid, maleic acid, methacrylic acid, hydroxypropyl acrylate, ethyl acrylate, vinyl acetate, or any combination thereof, or

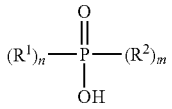

wherein $R^1$ and $R^2$ are, independently, acrylic acid, maleic acid, methacrylic acid, hydroxypropyl acrylate, ethyl acrylate, or vinyl acetate, and N(S) comprises the end component comprising nitrogen, sulfur, or any combination thereof; and cooking the wood that has been contacted with the composition to produce a pulp.

2. A process as in claim 1, wherein the polymer comprises acrylic acid, maleic acid, methacrylic acid, hydroxypropyl acrylate, ethyl acrylate, vinyl acetate, or combinations thereof.

3. A process as in claim 1, wherein the alkaline mixture comprises sodium hydroxide, sodium sulfide, sodium carbonate, or combinations thereof.

4. A process as in claim 1, wherein at least one end component comprises nitrogen, sulfur, or combinations thereof.

5. A process as in claim 1, wherein the phosphonate comprises isopropenyl phosphonic acid, or isopropenyl phosphonic acid anhydride, or any combination thereof.

6. A process as in claim 1, wherein the phosphonate is copolymerized with a monomer comprising acrylic acid, maleic acid, methacrylic acid, hydroxypropyl acrylate, ethyl acrylate, or vinyl acetate.

7. A process as in claim 1, wherein at least one end component comprises nitrogen and sulfur.

8. A process as in claim 1, wherein at least one end component comprises 2-acrylamido-2-methylpropane sulfonic acid.

9. A process as in claim 1, wherein at least one end component comprises acrylamide.

10. A process as in claim 1, wherein at least one of the following monomers is utilized to form the phosphinate in the polymer:

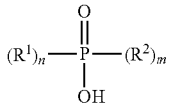

wherein $R^1$ and $R^2$ are, independently, acrylic acid, maleic acid, methacrylic acid, hydroxypropyl acrylate, ethyl acrylate, vinyl acetate, or any combination thereof.

11. A process for cooking wood in a cooking liquor medium comprising:

contacting wood with a composition comprising an alkaline mixture, a surface active agent, and at least one polymer stable at temperatures above 250° C., the at least one polymer comprising a carbon linear backbone segment having two end components, the at least one polymer comprising at least one phosphorus containing monomer, the phosphorus containing monomer comprising a phosphorous atom that is directly chemically linked to the linear backbone segment of the polymer, the phosphorus containing monomer comprising a phosphonate; and cooking the wood that has been contacted with the composition to produce a pulp.

12. A process as in claim 11, wherein at least one of the following monomers is utilized to form the phosphonate in the polymer:

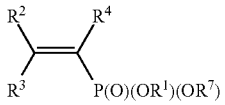

wherein $R^1$-$R^4$ and $R^7$ are, independently, hydrogen, an alkyl group, a cycloalkyl group, a heterocycloalkyl group, an aryl group, a heteroaryl group, a protecting group, or a combination thereof, or

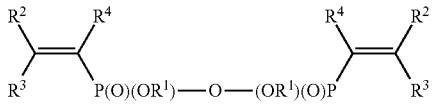

wherein $R^1$-$R^4$ and $R^7$ are, independently, hydrogen, an alkyl group, a cycloalkyl group, a heterocycloalkyl group, an aryl group, a heteroaryl group, a protecting group, or a combination thereof.

13. A process for cooking wood in a cooking liquor medium comprising;

contacting wood with a composition comprising an alkaline mixture, a surface active agent, and at least one polymer stable at temperatures above 250° C., the at least one polymer comprising a carbon and phosphorous linear backbone segment having two end components, the at least one polymer comprising at least one phosphorus containing monomer, the phosphorus containing monomer comprising a phosphorous atom that forms part of the linear backbone segment of the polymer, the phosphorus containing monomer comprising a phosphinate wherein the phosphinate is formed from a compound having the structure:

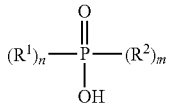

wherein $R^1$ and $R^2$ are, independently, acrylic acid, maleic acid, methacrylic acid, hydroxypropyl acrylate, ethyl acrylate, vinyl acetate, or any combination thereof, or

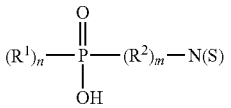

wherein $R^1$ and $R^2$ are, independently, acrylic acid, maleic acid, methacrylic acid, hydroxypropyl acrylate, ethyl acrylate, or vinyl acetate, and N(S) comprises the end component comprising nitrogen, sulfur, or any combination thereof; and cooking the wood that has been contacted with the composition to produce a pulp.

14. A process as in claim 13, wherein at least one of the following monomers is utilized to form the phosphinate in the polymer:

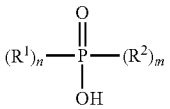

wherein $R^1$ and $R^2$ are, independently, acrylic acid, maleic acid, methacrylic acid, hydroxypropyl acrylate, ethyl acrylate, vinyl acetate, or any combination thereof.

15. A process for cooking wood in a cooking liquor medium comprising:

contacting wood with a composition comprising an alkaline mixture, a surface active agent, and at least one polymer stable at temperatures above 250° C., the at least one polymer comprising a carbon linear backbone segment having two end components or a carbon and phosphorous linear backbone segment having two end components, the at least one polymer comprising at least one phosphorus containing monomer, the phosphorus containing monomer comprising a phosphorous atom that is either directly chemically linked to the linear backbone segment of the polymer, forms part of the linear backbone segment of the polymer, or any combination thereof, the phosphorus containing monomer comprising a phosphonate, a phosphinate, or any combination thereof wherein the phosphorus containing monomer comprises only one phosphorus atom; and cooking the wood that has been contacted with the composition to produce a pulp.

16. A process as in claim 15, wherein the polymer comprises acrylic acid, maleic acid, methacrylic acid, hydroxypropyl acrylate, ethyl acrylate, vinyl acetate, or combinations thereof.

17. A process as in claim 15, wherein the phosphonate comprises isopropenyl phosphonic acid, or isopropenyl phosphonic acid anhydride, or any combination thereof.

18. A process as in claim 15, wherein at least one of the following monomers is utilized to form the phosphinate in the polymer:

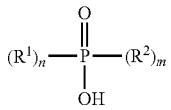

wherein $R^1$ and $R^2$ are, independently, acrylic acid, maleic acid, methacrylic acid, hydroxypropyl acrylate, ethyl acrylate, vinyl acetate, or any combination thereof, or

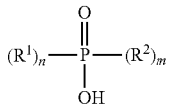

wherein $R^1$ and $R^2$ are, independently, acrylic acid, maleic acid, methacrylic acid, hydroxypropyl acrylate, ethyl acrylate, or vinyl acetate, and N(S) comprises the end component comprising nitrogen, sulfur, or any combination thereof.

19. A process as in claim 15, wherein at least one of the following monomers is utilized to form the phosphonate in the polymer:

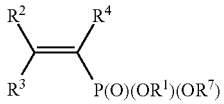

wherein $R^1$-$R^4$ and $R^7$ are, independently, hydrogen, an alkyl group, a cycloalkyl group, a heterocycloalkyl group, an aryl group, a heteroaryl group, a protecting group, or a combination thereof.

* * * * *